US007594400B2

(12) United States Patent
Szedlacsek et al.

(10) Patent No.: US 7,594,400 B2
(45) Date of Patent: Sep. 29, 2009

(54) CATALYTIC OXIDATION MODULE FOR A GAS TURBINE ENGINE

(75) Inventors: Peter Szedlacsek, Winter Park, FL (US); Gerald Joseph Bruck, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 700 days.

(21) Appl. No.: 11/101,248

(22) Filed: Apr. 7, 2005

(65) Prior Publication Data

US 2006/0225429 A1 Oct. 12, 2006

(51) Int. Cl.
*G02C 3/00* (2006.01)

(52) U.S. Cl. ..... 60/723; 60/777

(58) Field of Classification Search ..... 60/723, 60/777; 422/176, 222, 220; 431/7
See application file for complete search history.

(56) References Cited

U.S. PATENT DOCUMENTS

| | | | | |
|---|---|---|---|---|
| 3,938,326 | A | 2/1976 | DeCorso et al. | |
| 3,943,705 | A | 3/1976 | DeCorso et al. | |
| 4,112,675 | A | 9/1978 | Pillsbury et al. | |
| 4,845,952 | A | 7/1989 | Beebe | |
| 4,870,824 | A | 10/1989 | Young et al. | |
| 6,174,159 | B1 | 1/2001 | Smith et al. | |
| 6,358,040 | B1 | 3/2002 | Pfefferle et al. | |
| 6,533,088 | B2 * | 3/2003 | Hinkel | 192/3.29 |
| 6,752,623 | B2 * | 6/2004 | Smith et al. | 431/170 |
| 6,829,896 | B2 | 12/2004 | Bruck et al. | |
| 2002/0197578 | A1 * | 12/2002 | Smith et al. | 431/170 |
| 2003/0056511 | A1 | 3/2003 | Bruck et al. | |

* cited by examiner

*Primary Examiner*—Michael Cuff
*Assistant Examiner*—Phutthiwat Wongwian

(57) ABSTRACT

A catalytic oxidation module (28) for a gas turbine engine (10) includes a bundle (50) of tubular elements (30) separating a first fluid flow of a combustion mixture (24) from a second fluid flow (e.g., 26). Each of the tubular elements has an inlet end (42) and an outlet end (44) in fluid communication with a downstream plenum (36) and a respective end portion (60) comprising a plurality of spaced apart longitudinal fingers (58). The fingers of each tubular element are joined at abutting fingers of respective adjacent elements to retain the tubes at the respective end portions with sufficient flexibility to allow relative movement between the adjacent tubular elements. A catalyst (32) is disposed on respective surfaces of a plurality of the tubular elements exposed to at least one of the first fluid flow and second fluid flow.

28 Claims, 4 Drawing Sheets

CATALYTIC OXIDATION MODULE FOR A GAS TURBINE ENGINE

FIELD OF THE INVENTION

This invention relates to a catalytic oxidation module for a gas turbine engine, and, in particular, to a catalytic oxidation module comprising a plurality of tubular elements.

BACKGROUND OF THE INVENTION

Catalytic combustion systems are well known in gas turbine applications to reduce the creation of pollutants in the combustion process. As known, gas turbines include a compressor for compressing air, a combustion stage for producing a hot gas by burning fuel in the presence of the compressed air produced by the compressor, and a turbine for expanding the hot gas to extract shaft power. For example, U.S. Pat. No. 6,174,159 describes a catalytic oxidation method and apparatus for a gas turbine utilizing a backside cooled design. Multiple cooling conduits, such as tubes, are coated on the outside diameter with a catalytic material and are supported in a catalytic reactor portion of the combustor. A portion of a fuel/oxidant mixture is passed over the catalyst coated cooling conduits and is oxidized, while simultaneously, a portion of the oxidant enters the multiple cooling conduits and cools the catalyst. The exothermally catalyzed fluid then exits the catalytic oxidation system and is mixed with the cooling fluid outside the system, creating a heated, combustible mixture. The tubes used in such catalytic reactors are typically exposed to extreme temperature and vibration conditions which may adversely affect the integrity and service life of the tubes.

BRIEF DESCRIPTION OF THE DRAWINGS

These and other advantages of the invention will be more apparent from the following description in view of the drawings that show.

DETAILED DESCRIPTION OF THE INVENTION

Figure 1:
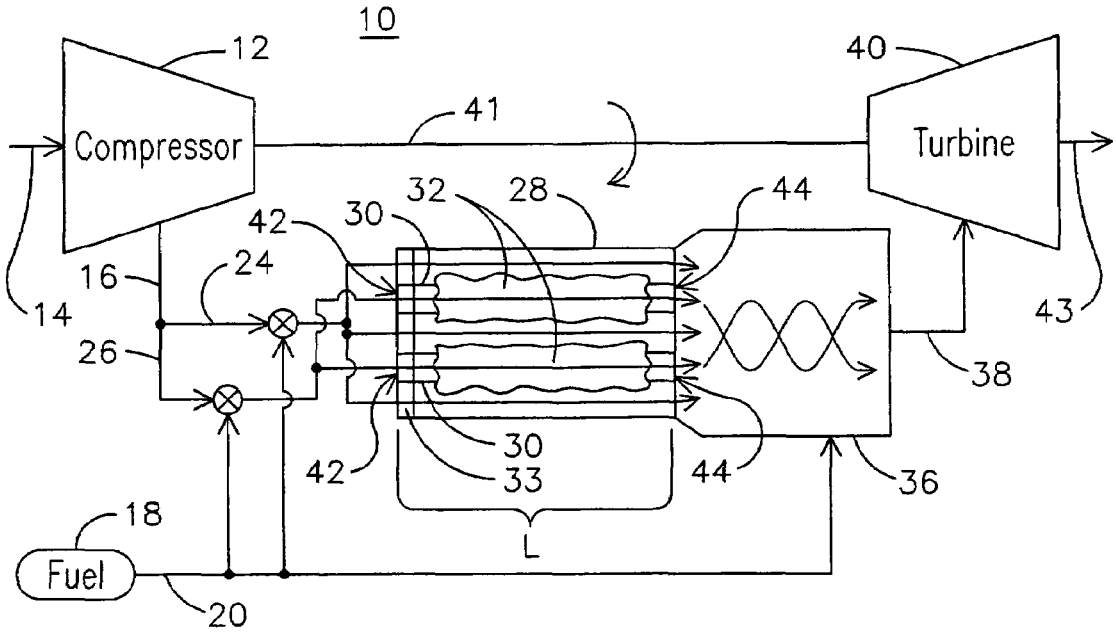
FIG. 1 is a functional diagram of a gas turbine engine having an improved catalytic oxidation module.

FIG. 1 illustrates a gas turbine engine 10 having a compressor 12 for receiving a flow of filtered ambient air 14 and for producing a flow of compressed air 16. The compressed air 16 is separated into a combustion mixture fluid flow 24 and a cooling fluid flow 26, respectively, for introduction into a catalytic combustion module 28. The combustion mixture fluid flow 24 is mixed with a flow of a combustible fuel 20, such as natural gas or fuel oil for example, provided by a fuel source 18, prior to introduction into the catalytic combustion module 28. The cooling fluid flow 26 may be introduced directly into the catalytic combustion module 28 without mixing with a combustible fuel. Optionally, the cooling fluid flow 26 may be mixed with a flow of combustible fuel 20 before being directed into the catalytic combustion module 28.

Inside the catalytic combustion module 28, the combustion mixture fluid flow 24 and the cooling fluid flow 26 are separated, for at least a portion of the travel length, L, by one or more conduits, such as tubular elements 30, having respective inlet ends 42 and an outlet ends 44. The tubular elements 30 may be retained in a spaced apart relationship by a tubesheet 33. The tubular elements 30 are coated with a catalyst 32 on the side exposed to the combustion mixture fluid flow 24. The catalyst 32 may include, as an active ingredient, a precious metal, Group VIII noble metals, base metals, metal oxides, or any combination thereof. Elements such as zirconium, vanadium, chromium, manganese, copper, platinum, palladium, osmium, iridium, rhodium, cerium, lanthanum, other elements of the lanthanide series, cobalt, nickel, iron, and the like may be used.

The tubular elements 30 may be coated on respective outside diameter surfaces with a catalyst 32 to be exposed to a combustion mixture fluid flow 24 traveling around the exterior of the elements 30. In a backside cooling arrangement, the cooling fluid flow 26 is directed to travel through the interior of the tubular elements 30. While exposed to the catalyst 32, the combustion mixture fluid flow 24 is oxidized in an exothermic reaction, and the catalyst 32 and the pressure boundary element 30 are cooled by the unreacted cooling fluid flow 26, thereby absorbing a portion of the heat produced by the exothermic reaction.

Alternatively, the tubular elements 30 may be coated on the respective interiors with a catalyst 32 to expose a combustion mixture fluid flow 24 traveling through the interior of the tubular elements 30, while the cooling fluid flow 26 travels around the exterior of the tubular elements 30. Other methods may be used to expose the combustion mixture fluid flow 24 to a catalyst 32, such as constructing a structure to suspend the catalyst in the combustion mixture fluid flow 24, constructing a structure from a catalytic material to suspend in the combustion mixture fluid flow 24, or providing pellets coated with a catalyst material exposed to the combustion mixture fluid flow 24.

After the flows 24,26 exit the catalytic combustion module 28, the flows 24,26 are mixed and combusted in a plenum, or combustion completion stage 36, to produce a hot combustion gas 38. In an embodiment of the invention, the flow of a combustible fuel 20 is provided to the combustion completion stage 36 by the fuel source 18. The hot combustion gas 38 is received by a turbine 40, where it is expanded to extract mechanical shaft power. A common shaft 41 may interconnect the turbine 40 with the compressor 12 as well as an electrical generator (not shown) to provide mechanical power for compressing the ambient air 14 and for producing electrical power, respectively. The expanded combustion gas 43 may be exhausted directly to the atmosphere or it may be routed through additional heat recovery systems (not shown).

Figure 2:
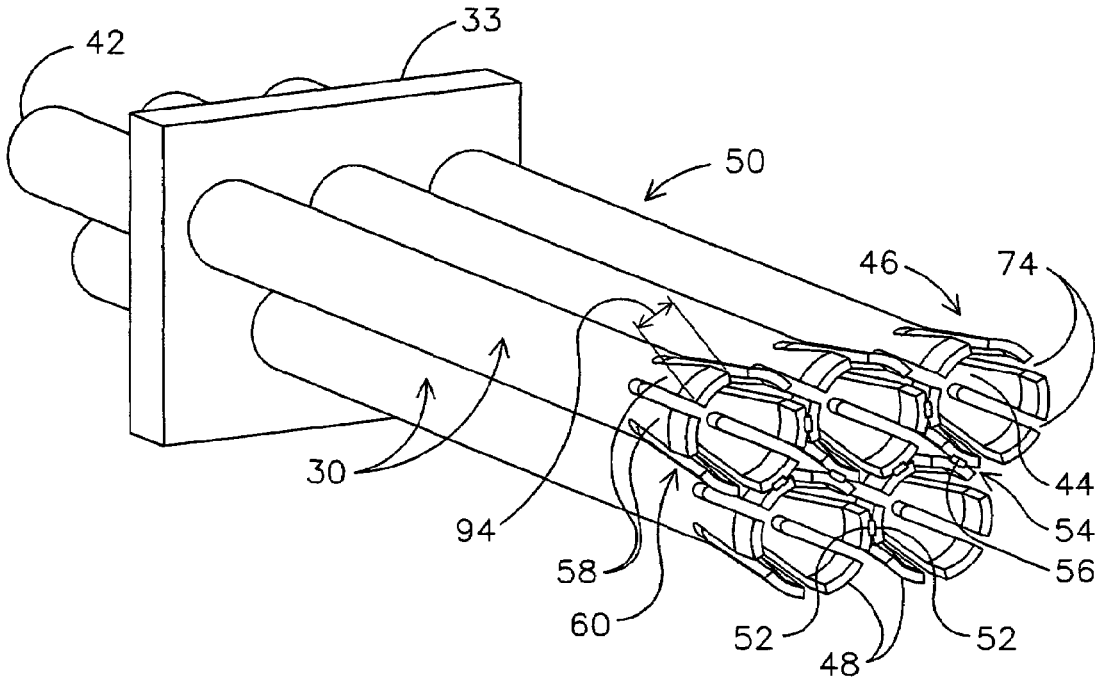
FIG. 2 is a perspective view of an exemplary bundle of tubular elements that may be used in the catalytic oxidation module of the gas turbine engine of FIG. 1.
Figure 3:
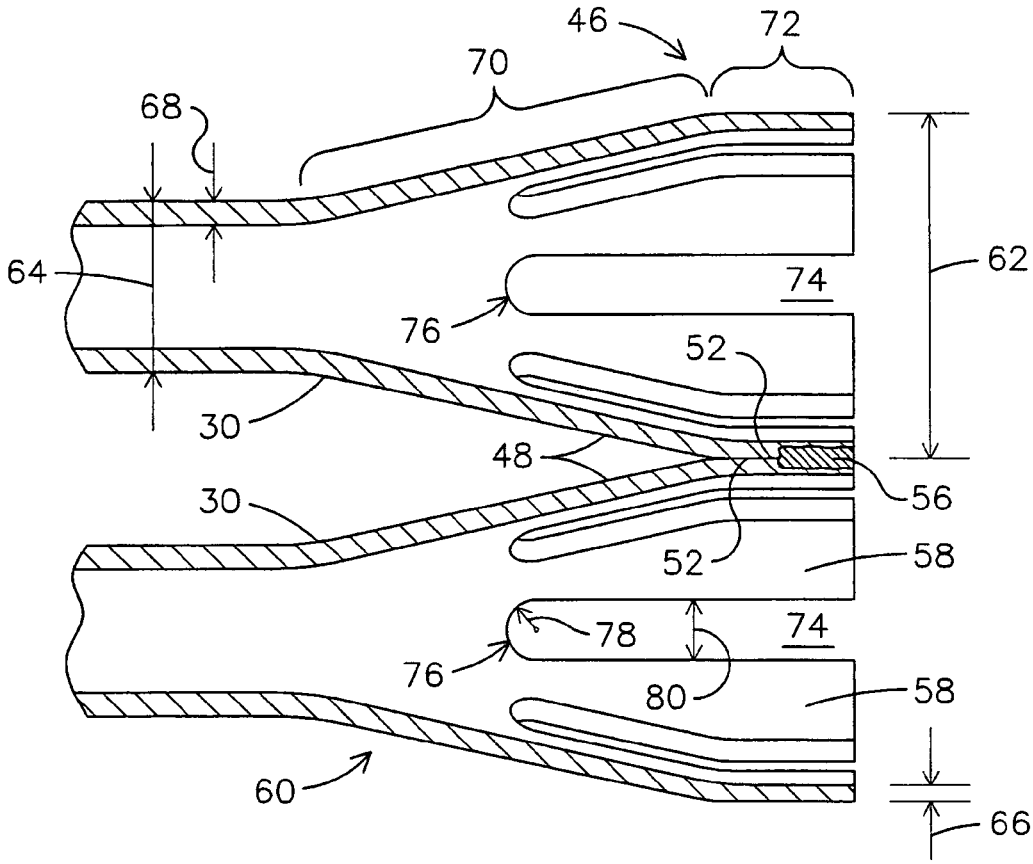
FIG. 3 is a partial cross sectional view of the tubular elements of FIG. 2.
Figure 4:
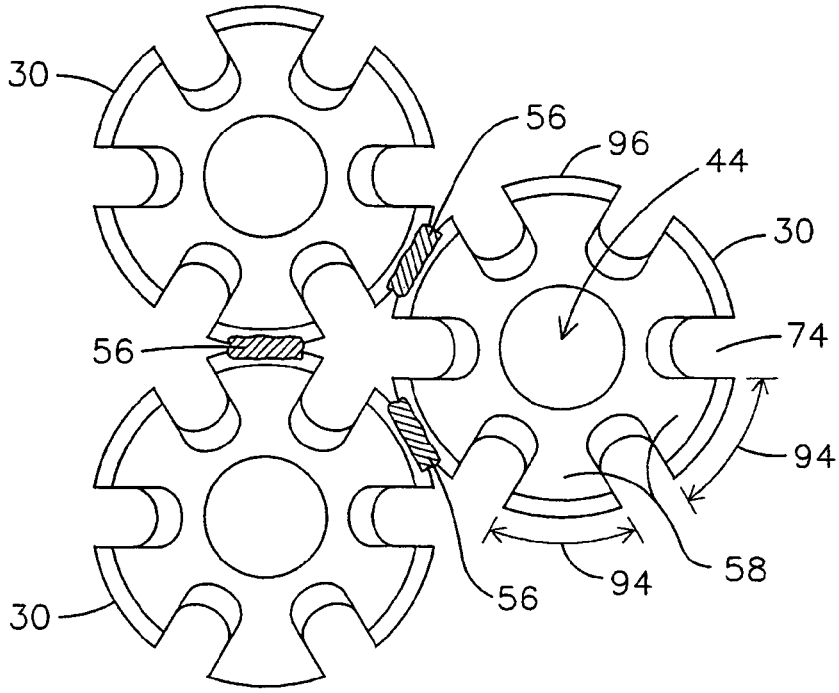
FIG. 4 is a partial end view of the tubular elements of FIG. 2.

The catalytic oxidation module 28 of FIG. 1 provides improved performance as a result of the retaining features of the tubular elements 30 that are shown more clearly in FIGS. 2-4. FIG. 2 shows a perspective view of an exemplary bundle 50 of tubular elements 30 that may be used in the catalytic oxidation module 28 of the gas turbine engine 10 of FIG. 1. In the past, bundled tubular elements 30 have been used in catalytic combustors 28, wherein respective inlet ends 42 of the tubular elements 30 have been retained spaced apart from one another by attaching, such as by welding or brazing, an upstream end of each of the elements 30 to a tubesheet 33. At the outlet ends 44, the tubular elements 30 have included an expanded cross section regions 46 having an outer surface 48 in contact with an outer surface 48 of expanded cross regions 46 of adjacent tubular elements 30 to maintain a spaced relationship among the tubular elements 30 and provide support for the elements 30 within the bundle 50 to provide a defined space in the combustion mixture catalytic reaction channels as well as vibration control.

However, such configurations have proven unreliable in the past due to conditions such as engine or flow induced dynamics, heat extremes, and differential heat induced expansion among the respective elements 30. For example, the expanded cross section regions 46 of the elements 30 are subject to wear (e.g. fretting or fret corrosion) where the surfaces 48 of the regions 46 contact one another. Although the expanded cross section regions 46 maintain the tubular elements 30 in a spaced relationship at respective outlet ends 44, such a configuration provides little self-containment of the tube elements 30 within in the module 50. For example, if an element 30 becomes dislodged from an upstream tubesheet 33, the expanded cross section region configuration cannot prevent the element 30 from traveling downstream and potentially causing catastrophic damage to the turbine 40 or other parts of the engine 10. A downstream tubesheet may be used to retain the elements at a downstream end of the bundle, but such a tubesheet may be subject to heat extremes and may introduce flashback and flame holding problems at the outlet ends 44.

The elements 30 may be joined, such as by welding or riveting, areas of contact, such as expanded cross section contact points 52, at the outlet ends 44 of the tubular elements 30. However, it has been discovered that elements 30 in the bundle 50 may expand and contract in a longitudinal direction at different rates due to differential heating. Such heat induced relative movement may cause stresses in joined contact points 54 sufficiently high enough to cause the joints, such as welds 56, to fail. If the elements 30 are retained at respective inlet ends 42 by the tubesheet 33 and at respective downstream ends by attachment to a downstream tubesheet, heat induced longitudinal expansion may cause bowing of the tubular elements 30 being restrained at both ends 42, 44 from moving in a longitudinal direction. The inventors have innovatively realized that by forming flexible fingers 58 in the ends 42, 44 of the elements 30, containment of the elements 30 at the ends 42, 44 may be achieved while still being capable of accommodating differential expansion and vibration.

Figure 8:
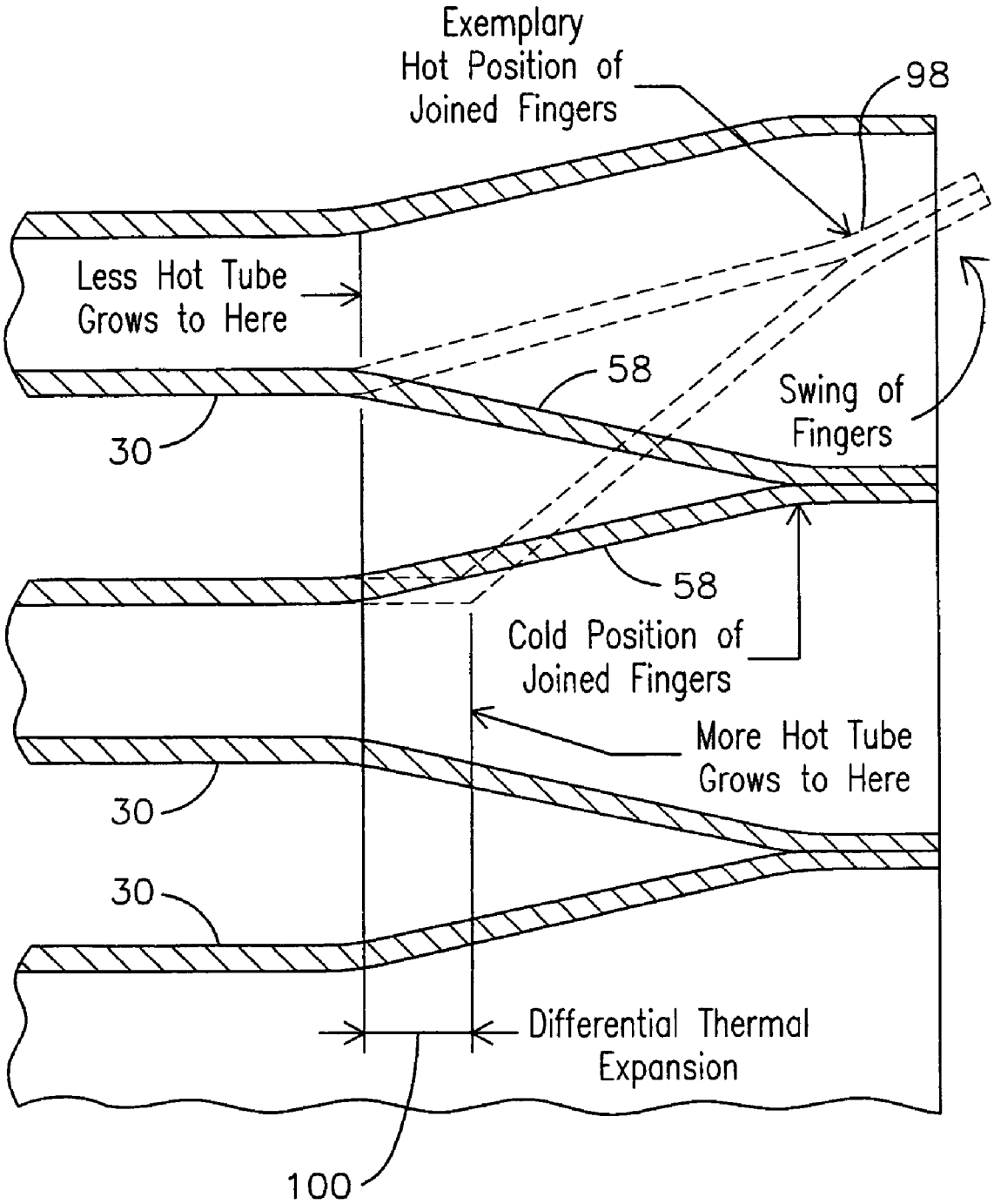
FIG. 8 depicts differential thermal expansion between the elements of FIG. 2

As shown in the perspective view of FIG. 2, the partial cross sectional view of the tubular elements of FIG. 3, and the partial end view of the tubular elements of FIG. 4, each of the tubular elements 30 includes a respective end portion 60 comprising a plurality of spaced apart longitudinal fingers 58. The fingers 58 of each tubular element 30 may be joined to abutting fingers 58 of respective adjacent elements to retain the tubular elements 30 at the end portions 60 with sufficient flexibility to allow relative movement between the adjacent tubular elements 30. For example, as shown in FIG. 8, differential thermal expansion 100 of adjacent elements 30 joined at contacting fingers 58 may be accommodated as indicated by dotted lines 98 showing positions of the joined fingers 58 when one of the elements 30 has expanded longitudinally with respect to the adjacent attached element 30.

The fingers 58 may be joined by forming a weld 56 (for example, using capacitance discharge welding, gas tungsten welding, or brazing techniques) between contact points 52 or contact areas of the abutting fingers 58 near the respective outlet ends 44 of the tubular elements 30. In an embodiment of the invention, the weld 56 may be formed as wide as an arc width 94 of the finger 58, and may extend upstream from the outlet end about 20 to 30 mils. In another embodiment, the fingers 58 may be joined by riveting. The fingers 58 may be formed integrally with a remainder of the tubular element 30 or may be joined, such as be welding, to an end of the tubular element 30, so that the fingers 58 are spaced apart around a perimeter of the end of the element 30 and extend longitudinally away from the end of element 30.

As shown in FIG. 3, the end portions 60 of each of the tubular elements 30 may comprise an expanded cross section region 46 having an expanded cross section 62 larger than a nominal cross section 64 of the tubular element 30. The expanded cross section region 46 may include a flared portion 70 transitioning from a nominal cross section 64 of the tubular element 30 to an expanded portion 72 having a larger cross section 62 than the nominal cross section 64. A wall thickness 66 of the expanded region 46 (and a corresponding thickness the fingers 58 formed in the expanded region 46) may be configured to be thinner than a wall thickness 68 of a nominal cross section 64 of the tubular element 30 so that the fingers 58 formed in the expanded cross section region 46 have a flexibility greater than a flexibility of fingers that may be formed in a thicker, nominal cross section portion of the element 64. The wall thickness 66 may be made thinner as a result of enlarging the nominal cross section 64 at an end of the element into an expanded cross section 62 in the expanded region 46. For example, it has been experimentally determined that when a 0.01 inch thick, 0.188 diameter cylindrical tube is expanded to have a diameter of 0.244 inches, the wall thickness of the expanded portion is thinned to 0.0075 inches. The fingers 58 may extend longitudinally through the expanded region 72 into the flared region 70 of the expanded portion 46.

Figure 5:
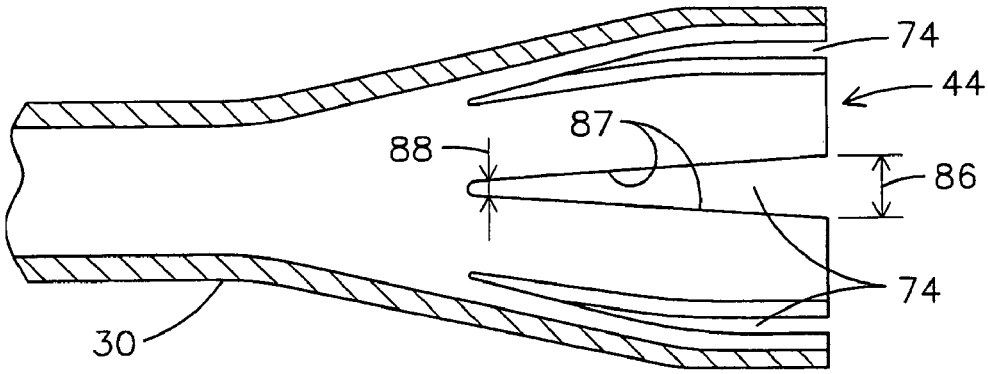
FIGS. 5-7 show exemplary slot configurations of the tubular elements of FIG. 2.
Figure 6:
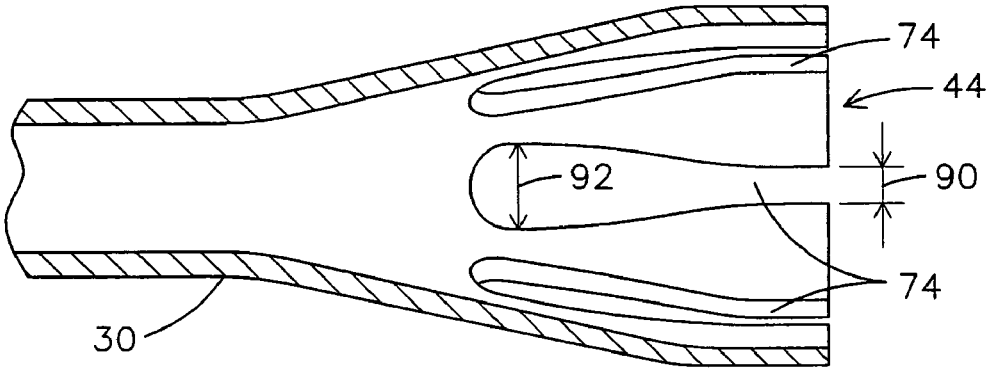
Figure 7:
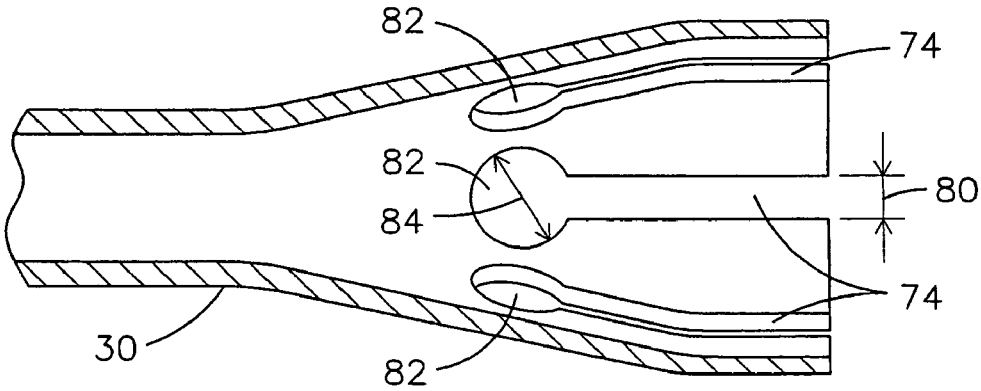

In an aspect of the invention, the fingers 58 are defined by slots 74 comprising a rounded bottom portion 76. The rounded bottom portion 76 may be configured as a semicircular shape having a radius 78 corresponding to half a width 80 of the slot 74. Other configurations of slots 74 that may be used are shown in FIGS. 5-7. FIGS. 5 and 6 show slots 74 having a variable slot width along a length of the slot 74. For example, FIG. 5 shows slots 74 comprising a slot width 86 at the outlet end 44 wider than a slot width 88 remote from the outlet end 44. FIG. 6 shows slots 74 comprising a slot width 90 at the outlet end 44 narrower than a slot width 92 remote from the outlet end 44. The slots 74 may have relatively straight sides 87 or may be contoured, for example, as shown in the exemplary slots 74 of FIG. 6, so that the slots have a tear-drop shape. In another aspect of the invention shown in FIG. 7, the slots 74 may include an enlarged circular bottom portion 82, for example, having a diameter 84 larger than the width 80 of the slot 74.

FIG. 4 is a partial end view of the tubular elements of FIG. 2. In the exemplary embodiment shown in FIG. 4, the tubular elements 30 have round cross sections. Other cross section profiles may include square, rectangular, oval, hexagonal or other shapes known in the art. As shown in FIG. 4, the arc width 94 of each of the fingers 58 at the outlet end 44 is sized sufficiently large to allow welding fingers 58 of adjacent elements 30 together. The arc width 94 of each of the fingers 58 may be modified to achieve a desired flexibility or stiffness of the finger 58 so that a larger arc width 94 provides increased stiffness, and a relatively smaller arc width 94 provides increased flexibility. In an aspect of the invention, a total combined arc width of the respective arc widths 94 of each of the fingers 58 of the tubular element at the outlet end 44 comprises from about 85 percent to 15 percent of the perimeter 96 of the tubular element 30 at the outlet end 44. Preferably, the total combined arc width of the fingers 58 comprises about 60 percent to 20 percent of the perimeter 96 of the tubular element at the outlet end 44. Even more preferably, the total combined arc width of the fingers 58 of each tubular element 30 comprises about 50 percent to 40 percent of the perimeter 96 of the tubular element 58 at the outlet end 44.

With reference to FIG. 2, a method of assembling a catalytic module 50 including tubular elements 30 having a plurality of spaced apart longitudinal fingers 58 formed in respective end regions 60 includes assembling the elements 30 into a bundle and joining end regions 60, such as the expanded cross section regions 46, of each of the tubular elements 30 in the bundle 50 at points of contact 52 among the tubular elements 30. For example, the end regions 60 may be welded or riveted at the contact points 52. After being joined, longitudinal slots 74 may be formed the end regions away from the joined contact points 52 to define joined fingers 58 between the slots 74 so that the joined fingers 58 remaining after forming the slots 74 are capable of retaining the tubular elements 30 at the respective end regions 60 with sufficient flexibility to allow relative movement between adjacent tubular elements 30. The slots 74 may be formed by sawing, laser cutting, or abrading away portions of the element 30 in the end portion 60. For example, an abrasive wheel may be configured to have a cross section corresponding to a desired slot contour, such as slots 74 having the configurations as shown in FIGS. 5-7. To provide increased resistance to cracking, the slots 74 may be formed to have a rounded bottom portion 76 as shown in FIG. 3. In another aspect shown in FIG. 7, the slots 74 may be formed to have an enlarged circular bottom portion 82 in each slot, such as by drilling a hole before or after forming the slot 74, so that the hole intersects a bottom portion of the slot 74.

While the preferred embodiments of the present invention have been shown and described herein, it will be obvious that such embodiments are provided by way of example only. Numerous variations, changes and substitutions will occur to those of skill in the art without departing from the invention herein. For example, the fingers may be formed in respective inlet ends of the tubular elements and welded to fingers of adjacent tubular elements. In another aspect, straight tubes, not having an enlarged cross section region may be used. Accordingly, it is intended that the invention be limited only by the spirit and scope of the appended claims.

We claim as our invention:

1. A catalytic oxidation module for a gas turbine engine combustor comprising:

a bundle of tubular elements, each of the tubular elements having an inlet end and an outlet end in fluid communication with a downstream plenum, the tubular elements separating a first fluid flow of a combustion mixture from a second fluid flow;

each of the tubular elements having a respective end portion comprising a plurality of spaced apart longitudinal fingers, the fingers of each tubular element joined at abutting fingers of respective adjacent tubular elements, wherein the abutting fingers are adapted to freely flex in response to longitudinal movement of at least one of the respective adjacent tubular elements; and a catalytic material disposed on respective surfaces of a plurality of the tubular elements exposed to at least one of the first fluid flow and second fluid flow.

2. The catalytic oxidation module of claim 1, wherein the end portion comprises an expanded cross section region.

3. The catalytic oxidation module of claim 2, wherein a wall thickness of the fingers disposed in the expanded cross section region is thinner than a wall thickness of a nominal cross section region of the tubular element so that the fingers formed in the expanded cross section region have a flexibility greater than a flexibility of fingers formed in a nominal cross section region.

4. The catalytic oxidation module of claim 2, wherein the expanded cross section region comprises a flared portion transitioning from a nominal cross section of the tubular element to an expanded portion having larger cross section than the nominal cross section.

5. The catalytic oxidation module of claim 2, further comprising a tubesheet retaining each of the tubular elements and disposed remote from the end portion.

6. The catalytic oxidation module of claim 1, wherein the plurality of fingers are joined to a remainder of the tubular element.

7. The catalytic oxidation module of claim 1, wherein the plurality of fingers are integral with a remainder of the tubular element.

8. The catalytic oxidation module of claim 1, wherein the expanded portion comprises a flared region transitioning from a nominal cross sectional area of the tubular element to an expanded region having larger cross sectional area than the nominal cross sectional area.

9. The catalytic oxidation module of claim 8, wherein the fingers extend longitudinally through the expanded region into the flared region of the expanded portion.

10. The catalytic oxidation module of claim 1, further comprising a weld attaching the at least one of the plurality of fingers of the first element to the at least one of the plurality of fingers of the adjacent second tubular element.

11. The catalytic oxidation module of claim 1, further comprising a rivet attaching the at least one of the plurality of fingers of the first element to the at least one of the plurality of fingers of the adjacent second tubular element.

12. The catalytic oxidation module of claim 1, wherein the fingers are defined by slots comprising a rounded bottom portion.

13. The catalytic oxidation module of claim 12, wherein the rounded bottom comprises a semicircle shape having a radius corresponding to half a width of the slot.

14. The catalytic oxidation module of claim 1, wherein the fingers are defined by slots comprising an enlarged circular bottom portion.

15. The catalytic oxidation module of claim 1, wherein the fingers are defined by slots having a variable slot width along the length of the slot.

16. The catalytic oxidation module of claim 15, wherein the slots comprise a slot width at the end portion wider than a slot width remote from the end portion.

17. The catalytic oxidation module of claim 15, wherein the slots comprise a slot width at the end portion narrower than a slot width remote from the end portion.

18. The catalytic oxidation module of claim 1, wherein the fingers comprise an arc width at the end portion sufficiently large to allow welding fingers of adjacent elements together.

19. The catalytic oxidation module of claim 1, wherein a total combined arc width of the fingers of each tubular element at the end portion comprises 85 percent to 15 percent of the circumference of the tubular element at the end portion.

20. The catalytic oxidation module of claim 19, wherein a total combined arc width of the fingers of each tubular element at the end portion comprises 60 percent to 20 percent of the circumference of the tubular element at the end portion.

21. The catalytic oxidation module of claim 20, wherein a total combined arc width of the fingers of each tubular element at the end portion comprises 50 percent to 40 percent of the circumference of the tubular element at the end portion.

22. The catalytic oxidation module of claim 1, wherein the second fluid flow comprises a cooling fluid containing no combustible fuel.

23. A gas turbine engine comprising:

a compressor for supplying a first and second fluid flow of compressed air; a fuel supply for injecting a combustible fuel into the first fluid flow;

a catalytic oxidation module comprising an array of tubular elements spaced apart from one another and separating a first fluid flow of a combustion mixture from a second fluid flow, each of the tubular elements having a respective expanded portion comprising a plurality of longitudinal slots forming a plurality of annularly spaced apart longitudinal fingers, at least one of the plurality of fingers of a first tubular element attached to at least one of the plurality of fingers of an adjacent second tubular element, wherein the attached fingers are adapted to freely flex in response to longitudinal movement of at least one of the first tubular element and the second tubular element;

a combustion completion chamber receiving the first and second fluid flows from the catalytic oxidation module and producing a hot gas; and a turbine for receiving the hot gas from the combustion completion chamber.

24. A method of assembling a catalytic oxidation module for a gas turbine engine comprising:

assembling a plurality of tubular elements into a bundle;

joining end portions of each of the tubular elements in the bundle at points of contact among the tubular elements of the bundle; and forming longitudinal slots in the end portions of the tubular elements away from joined points of contact to define a plurality of spaced apart joined fingers in the end portions of each of the tubular elements between the slots, wherein the joined fingers comprise fingers of each tubular element joined at fingers of respective adjacent tubular elements, and wherein the joined fingers are capable of retaining the tubular elements at the respective end portions thereof such that the joined fingers are adapted to freely flex in response to longitudinal movement of a respective tubular element.

25. The method of claim 24, wherein the slots are formed by abrading away portions of the tubular elements.

26. The method of claim 24, further comprising forming a rounded bottom in each slot.

27. The method of claim 24, further comprising forming an enlarged circular bottom portion in each slot.

28. The method of claim 25, further comprising forming an enlarged circular bottom portion in each slot.

* * * * *